United States Patent [19]

Kishi

[11] Patent Number: 4,638,887

[45] Date of Patent: Jan. 27, 1987

[54] ELEVATING APPARATUS

[75] Inventor: Mitsuhiro Kishi, Ashikaga, Japan

[73] Assignee: Kabushiki Kaisha Hikoma Seisakusho, Tochigi, Japan

[21] Appl. No.: 728,838

[22] Filed: Apr. 30, 1985

[30] Foreign Application Priority Data

| | | | |
|---|---|---|---|
| May 1, 1984 | [JP] | Japan | 59-88150 |
| May 14, 1984 | [JP] | Japan | 59-95797 |
| Jun. 4, 1984 | [JP] | Japan | 59-115239 |
| Jun. 4, 1984 | [JP] | Japan | 59-115240 |
| Apr. 8, 1985 | [JP] | Japan | 60-74044 |

[51] Int. Cl.[4] ..... B66B 9/20

[52] U.S. Cl. ..... 187/9 R; 182/141; 182/2

[58] Field of Search ..... 187/9 R, 18, 8.71, 8.72; 182/141, 63, 2; 212/230, 231, 256, 264, 267, 268; 52/116, 118; 414/685, 708, 590

[56] References Cited

U.S. PATENT DOCUMENTS

| | | | |
|---|---|---|---|
| 3,516,513 | 6/1970 | Robertson et al. | 182/141 |
| 3,893,540 | 7/1975 | Beucher | 182/141 |
| 4,116,304 | 9/1978 | Durnell | 182/2 |
| 4,185,426 | 1/1980 | Prescott | 182/2 |
| 4,518,061 | 5/1985 | Wehmeyer et al. | 182/141 |

FOREIGN PATENT DOCUMENTS

| | | | |
|---|---|---|---|
| 3326673 | 12/1984 | Fed. Rep. of Germany | 182/141 |

*Primary Examiner*—Joseph J. Rolla
*Assistant Examiner*—Kenneth Noland
*Attorney, Agent, or Firm*—Koda and Androlia

[57] ABSTRACT

An elevating apparatus includes a base such as a mobile chassis, a platform, a telescopic boom assembly connecting the base and the platform together, the telescopic boom assembly being composed of a plurality of telescopically coupled booms axially aligned with each other, at least one first hydraulic cylinder disposed in the telescopic boom assembly for extending and contracting the telescopic boom assembly, a pair of second parallel hydraulic cylinders operatively coupled between the telescopic boom assembly and the base for tilting the telescopic boom assembly with respect to the base, a pair of parallel third hydraulic cylinders operatively coupled between the telescopic boom assembly and the platform for keeping the platform substantially parallel to the base, and a hydraulic control system for operating the first, second, and third hydraulic cylinders in synchronism to move the platform toward and away from the base in a substantially perpendicular relation to the base while the platform is stably maintained parallel to the base.

16 Claims, 24 Drawing Figures

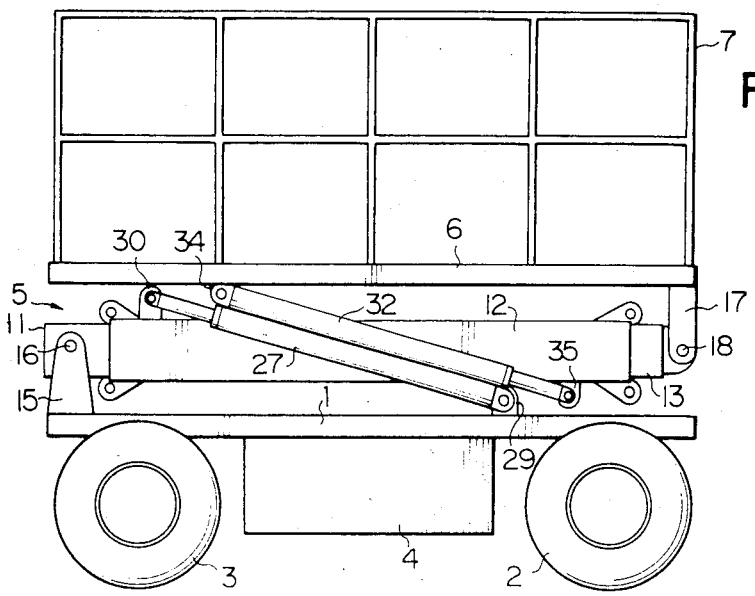
FIG. 2
FIG. 3
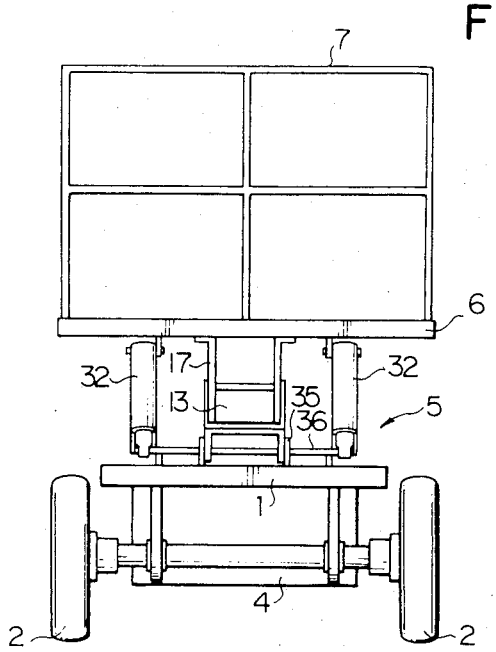

ELEVATING APPARATUS

BACKGROUND OF THE INVENTION

The present invention relates to an elevating apparatus or lift for elevating a lifting table or platform to lift workers and/or materials to higher places for assembly, painting, repair or various other labor activities.

There have heretofore been used elevating apparatus for elevating a lifting table or platform to lift workers and/or materials to higher places for assembly, painting, repair in various locations such as construction sites, highways, and other areas requiring work at elevated levels. Such conventional elevating apparatus include scissors-type lifts in the form of a pantograph comprising a plurality of vertically connected X-shaped arms with two arms in each X-shaped arm unit being centrally pivotally interconnected. However, in order to raise the lifting table to a higher position, the number of X-shaped arm units has to be increased. This has led to problems in that the collapsed lift has an increased height, and workers will encounter difficulty in getting on and off the platform and in loading and unloading materials onto and from the platform. To avoid such drawbacks, there has been proposed an elevating apparatus having an extensible and contractable arm assembly accommodating a plurality of telescopic booms that the arm assembly can longitudinally be extended and contracted. With this proposed elevating apparatus, two booms are combined into a centrally pivoted X-shaped boom assembly, and two of such boom assemblies are disposed parallel to each other on mobile chassis, the mobile chassis and the platform being interconnected by four upper and lower arms. Since the number of the booms used is large, the elevating apparatus is complex in structure, cannot easily be assembled, and is expensive to manufacture. The booms and arms are held in sliding contact with each other through sliders of synthetic resin such as MC nylon, which are required to be replaced at regular intervals. As a consequence, it is costly and time-consuming to inspect and service the elevating apparatus constructed of telescopic booms.

SUMMARY OF THE INVENTION

It is an object of the present invention to provide an elevating apparatus which is simple in construction and can easily be manufactured and inspected.

Another object of the present invention is to provide an elevating apparatus which allows workers and materials to easily be placed on or off the lifting table or platform when the lifting mechanism is collapsed.

According to the present invention, there is provided an elevating apparatus including a base such as a mobile chassis, a platform, a telescopic boom assembly connecting the base and the platform together, the telescopic boom assembly being composed of a plurality of telescopically coupled booms axially aligned with each other, at least one first hydraulic cylinder disposed in the telescopic boom assembly for extending and contracting the telescopic boom assembly, at least one second hydraulic cylinder operatively coupled between the telescopic boom assembly and the base for tilting the telescopic boom assembly with respect to the base, at least one third hydraulic cylinder operatively coupled between the telescopic boom assembly and the platform for keeping the platform substantially parallel to the base, and a hydraulic control system for operating the first, second, and third hydraulic cylinders in synchronism to move the platform toward and away from the base in a substantially perpendicular relation to the base.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 2 is a side elevational view of the elevating apparatus of FIG. 1 as it is collapsed;

FIG. 3 is a front elevational view of the elevating apparatus shown in FIG. 2;

DESCRIPTION OF THE PREFERRED EMBODIMENTS

Figure 1:
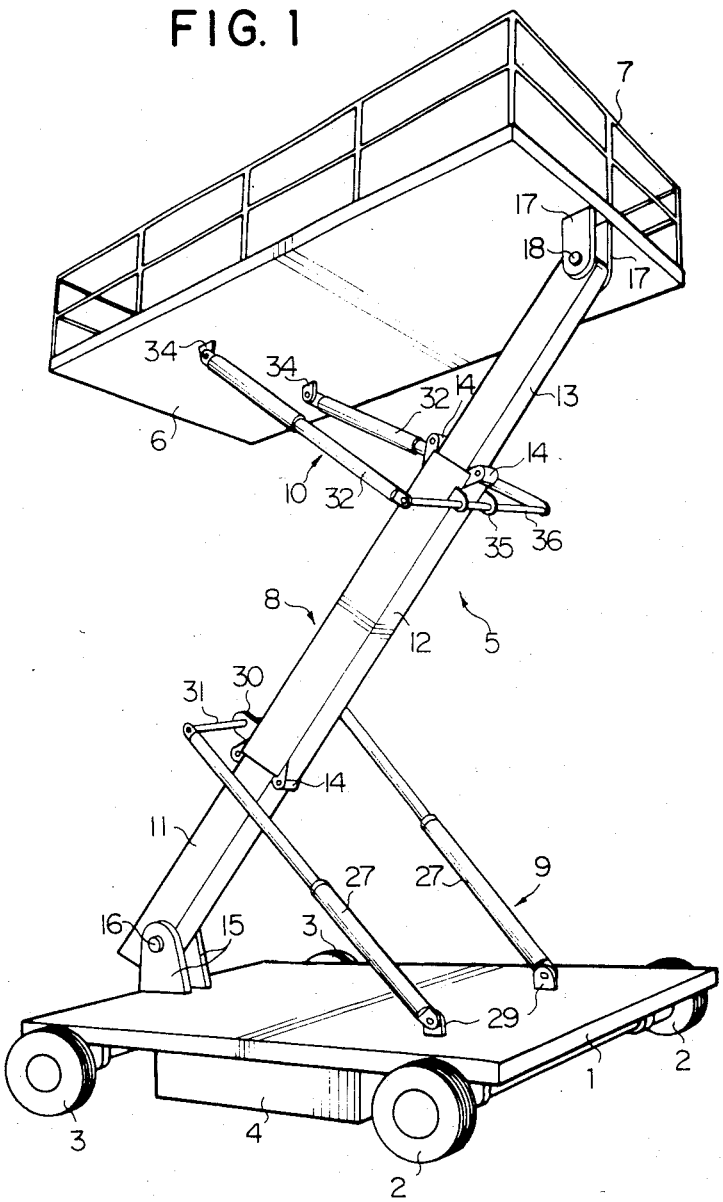
FIG. 1 is a perspective view of an elevating apparatus according to an embodiment of the present invention.
Figure 4:
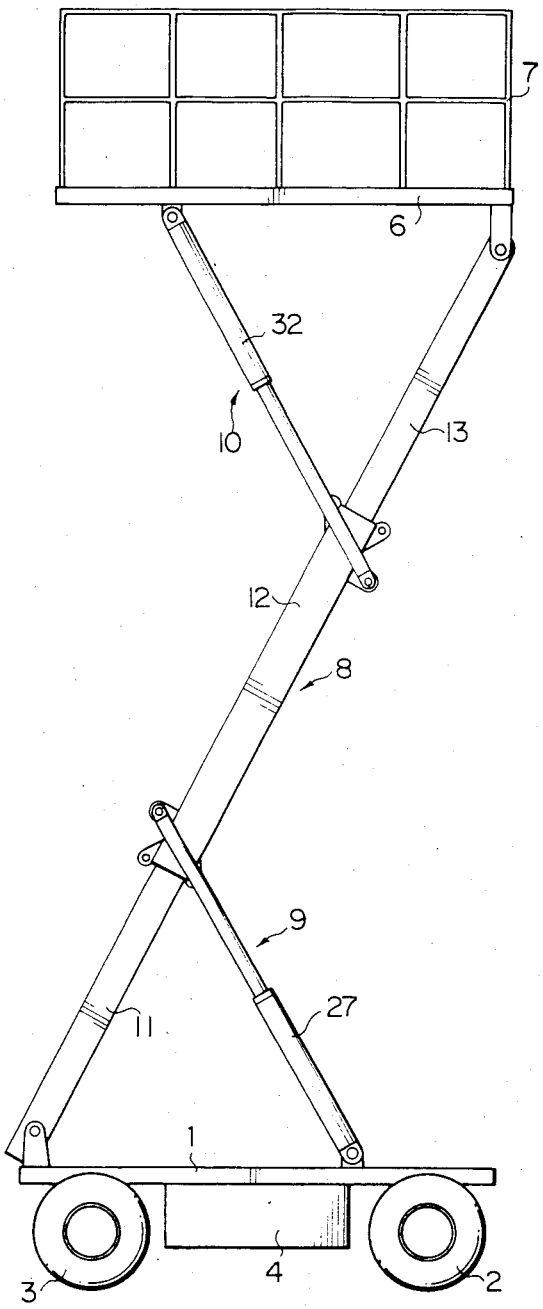
FIG. 4 is a side elevational view of the elevating apparatus with its platform elevated to a highest position.

Identical or corresponding components are designated by identical or corresponding reference characters throughout the views.

FIGS. 1 through 7 show an elevating apparatus according to an embodiment of the present invention. As shown in FIGS. 1 through 5, the elevating apparatus comprises a mobile chassis or base 1 on which front and rear wheels 2, 3 are rotatably supported, a power box 4 attached to the lower surface of the chassis 1 and accommodating therein an engine, a hyraulic pump and other parts, and an elevating device 5 mounted on the chassis 1 and including a lifting table or platform 6 with handrails 7 extending therearound.

The elevating device 5 includes a telescopic boom assembly 8 connected between the chassis 1 and the platform 6 substantially in the form of a Z, when seen in side elevation, a lifting mechanism 9 connected between the chassis 1 and the telescopic boom assembly 8, and a correcting mechanism 10 connected between the telescopic boom assembly 8 and the platform 6.

The telescopic boom assembly 8 is composed of a hollow lower boom 11, a hollow middle boom 12, and a hollow upper boom 13, each of a rectangular cross section. The middle boom 12 is of the thickest shape, the lower boom 11 the next thickest, and the upper boom 13 the thinnest. The lower boom 11 is telescopically disposed in the middle boom 12, while the upper boom 13 is telescopically disposed in the lower boom 11, the lower and upper booms 11, 13 being guided by guide rollers 14 on the middle boom 12 for their telescopic movement. The lower boom 11 has a lower end pivotally coupled by a pin 16 to a pair of spaced support legs 15 mounted on the chassis 1 at an end thereof close to the rear wheel 3, the support legs 15 being positioned transversely centrally of the chassis 1. The upper boom 13 has an upper end pivotally coupled by a pin 18 to a pair of spaced support legs 17 mounted on the lower surface of the platrom 6 at a front end thereof, the support legs 17 being positioned transversely centrally of the platform 6.

Figure 6:
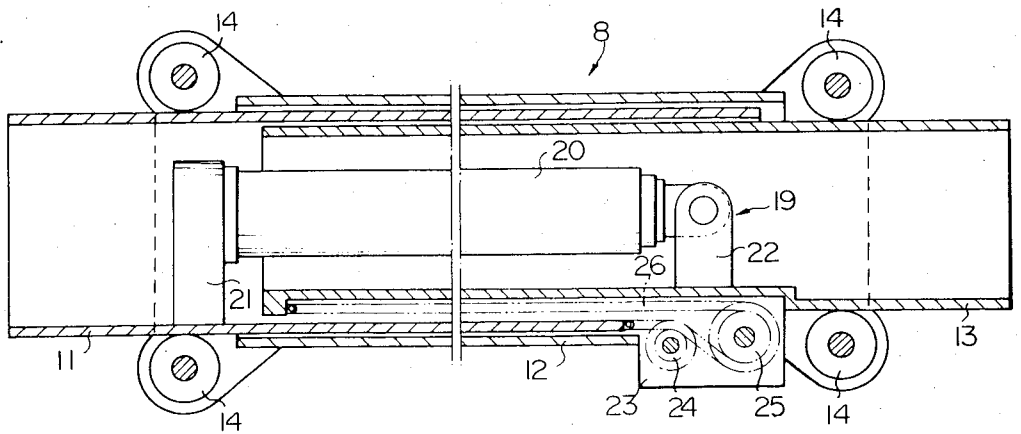
FIG. 6 is a longitudinal cross-sectional view of a telescopic boom assembly of the elevating apparatus.

As shown in FIG. 6, an extension and contraction mechanism 19 is disposed in the telescopic boom assembly 8, and includes a single hydraulic cylinder 20 coupled between the lower and upper booms 11, 13. The hydraulic cylinder 20 has a cylinder end fixed by an attachment 21 to the lower boom 11, and a rod end fixed by an attachment 21 to the upper boom 13. The extension and contraction mechanism 19 also includes an endless cord member 26 connected at the ends to the lower and upper booms 11, 13 and trained around rollers 24, 25 rotatably mounted on a case 23 integral with the middle boom 12. The endless cord member 26 coupled to the lower and upper booms 11, 13 serves to allow them to telescopically move at equal intervals simultaneously with respect to the middle boom 12.

Figure 5:
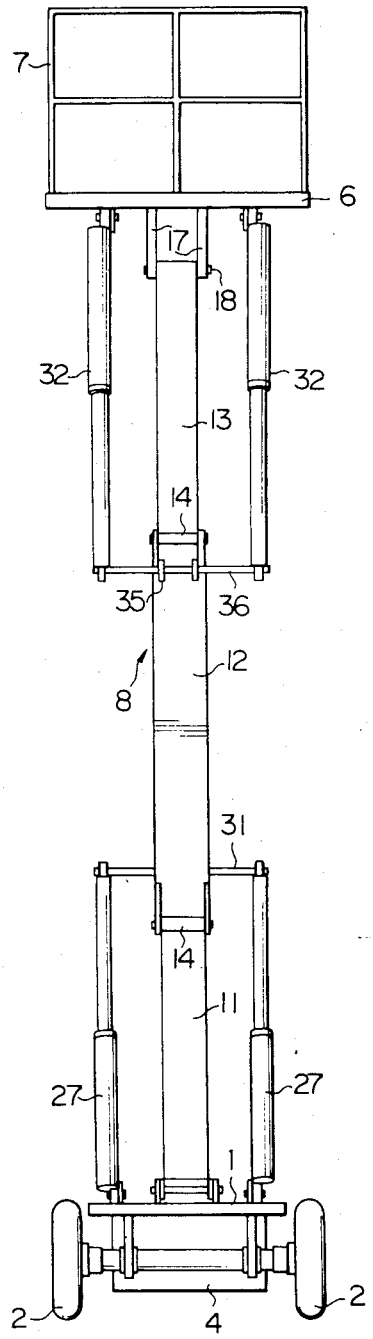
FIG. 5 is a front elevational view of the elevating apparatus shown in FIG. 4.

As better shown in FIGS. 1 and 5, the lifting mechanism 9 is composed of two parallel spaced-apart hydraulic cylinders 27, 27 each having a cylinder end coupled by a connector 29 to the chassis 1 remotely from the support legs 15 and a rod end coupled to an arm 31 supported by a support 30 fixed to the lower end of the middle boom 12 remotely from the connector 29. The two hydraulic cylinders 27 extend parallel to each other in a direction across the middle boom 12 at its lower end. The correcting mechanism 10 is of a similar construction composed of two parallel spaced-apart hydraulic cylinders 32 each having a cylinder end coupled by a connector 34 to the platform 6 remotely from the support legs 17 and a rod end coupled to a arm 36 supported by a support 35 fixed to the upper end of the middle boom 12 remotely from the connector 34. The two hydraulic cylinders 32 extend parallel to each other in a direction across the middle boom 12 at its upper end. The hydraulic cylinders 32 also extend parallel to the hydraulic cylinders 27.

Figure 7:
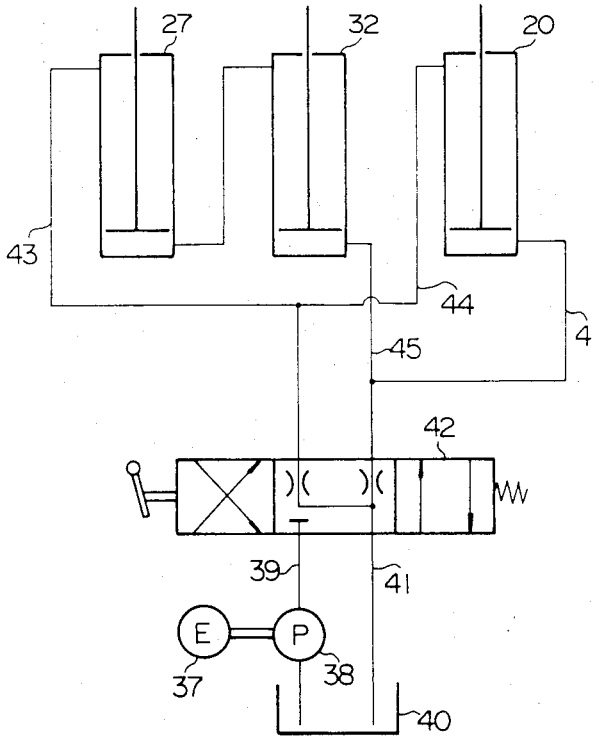
FIG. 7 is a circuit diagram of a hydraulic control system of the elevating apparatus.

FIG. 7 shows a hydraulic control system having an engine 37 operatively coupled to a hydraulic pump 38 coupled by an oil passage 39 to a manual directional control valve 42, the hydraulic pump 38 being also connected to an oil reservoir 40. The oil reservoir 40 is connected by a drain passage 41 to the manual directional control valve 42. The manual directional control valve 42 is coupled to a common supply passage which is divided into two parallel supply passages 43, 44, the supply passage 43 being connected to the hydraulic cylinders 27, 32 (only one each shown in FIG. 7) connected in series with each other, and the supply passage 44 being connected to the hydraulic cylinder 20. Return passages 45, 46 respectively from the hydraulic cylinders 32, 20 are connected through a common return passage to the manual directional control valve 42.

Operation of the elevating apparatus of the foregoing construction is as follows: When the hydraulic cylinders 27, 30, 20 are contracted as shown in FIG. 7, the lower and upper booms 11, 13 are contracted and accommodated in the middle cylinder 12. The boom assembly 8 as it is contracted lies horizontally on the chassis 1 as shown in FIG. 2, with the platform 6 placed horizontally on the contracted boom assembly 8. At this time, the hydraulic cylinders 27, 32 are slightly inclined in vertically superimposed relation. The elevating device 5 is now collapsed as illustrated in FIGS. 2 and 3.

When a worker or workers and/or materials are put on the platform 6 and the directional control valve 42 is manually shifted to the right (FIG. 7), oil under pressure is supplied from the pump 38 through the valve 42 simultaneously into the piston-side chambers of the hydraulic cylinders 27, 32, 20 which start to extend. The lower and upper booms 11, 13 now start being extended simultaneously at equal intervals out of the ends of the middle boom 12. At the same time, as the hydraulic cylinders 27 are extended, the boom assmembly 8 is tilted about the pin 16 in an upward direction. As the hydraulic cylinders 32 are also extended, the platform 6 is also tilted about the pin 18 through the same angle as that of tilting movement of the boom assembly 8, so that the platform 6 is angularly moved away from the boom assembly 8. Since the boom assembly 8 is angularly moved away from the chassis 1 and the platform 6 is also angularly moved away from the boom assembly 8 through the same angular interval, the hydraulic cylinders 27, 32 are kept parallel to each other at all times. The triangle formed between the chassis 1, the lower boom 11, and the hydraulic cylinders 27 and the triangle formed between the platform 6, the upper boom 13, and the hydraulic cylinders 32 are congruent at all times. Therefore, the paltform 6 is lifted upwardly directly above the chassis 1, while being maintained horizontally, up to the position of FIGS. 4 and 5.

When a desired lifted position is reached, the directional control valve 42 is manually shifted back to the neutral position. The extending movement of the hydraulic cylinders 27, 32, 20 is stopped to keep the platform 6 in the lifted position, where desired working activities can be performed on the platform 6.

When the directional control valve 42 is shifted to the left, oil under pressure from the pump 38 is supplied simultaneously into the rod-side chambers of the hydraulic cylinders 27, 32, 20 to contract them. The boom assembly 8 and the mechanisms 9, 10 are now reversed in operation to lower the platform 6 down to the collapsed position while being kept horizontally, as shown in FIGS. 2 and 3.

Since the platform 6 can be lowered to a low position with the hyraulic cylinders 27, 32 superimposed, the worker or workers and/or materials can easily be taken onto or off the platform 6, and the elevating apparatus as collapsed can be stored in a small space. The hydraulic cylinders 27, 32 are simple in assembly as they are disposed parallel to each other and connected for angular movement in two-dimensional planes. The hydraulic control system is simple in structure since the hydraulic cylinders 27, 32, 20 are operated in synchronism.

FIGS. 8 through 14 show an elevating apparatus according to another embodiment of the present invention. The elevating apparatus illustrated in FIGS. 8 through 11 includes an elevating device 50 having a telescopic boom assembly 51 connected between the chassis 1 and the platform 6 substantially in the form of a Z, when seen in side elevation, a lifting mechanism 52 connected between the chassis 1 and the telescopic boom assembly 51, and a correcting mechanism 53 connected between the telescopic boom assembly 51 and the platform 6.

The telescopic boom assembly 51 is composed of a hollow lower outer boom 54, a hollow middle boom 55, a hollow upper boom 56, and a hollow upper outer boom 57, each of a rectangular cross section. The lower and upper outer booms 54, 57 are closed at one end. The middle and upper booms 55, 56 are hollow throughout their entire lengths. The middle boom 55 is slightly smaller in cross-sectional size than the lower and upper outer booms 54, 57, and the upper boom 56 is slightly smaller in cross-sectional size than the middle boom 55. The lower outer boom 54 has a lower end pivotally coupled by a pin 58 to a pair of spaced support legs 59 mounted on the chassis 1 at an end thereof close to the rear wheel 3, the support legs 59 being positioned transversely centrally of the chassis 1. The upper outer boom 57 has an upper end pivotally coupled by a pin 60 to a pair of spaced support legs 61 mounted on the lower surface of the platrom 6 at a front end thereof, the support legs 61 being positioned transversely centrally of the platform 6.

The lifting mechanism 52 is composed of a pair of hydraulic cylinders 62 each having a cylinder end pivotally coupled by connectors 63 to the chassis 1 remotely from the support legs 59 and a rod end pivotally coupled to one side of the lower outer boom 54. The correcting mechanism 53 is also composed of a pair of hydraulic cylinders 64 each having a cylinder end pivotally coupled by connectors 65 to the platform 6 remotely from the support legs 61 and a rod end pivotally coupled to one side of the upper outer boom 57.

Figure 8:
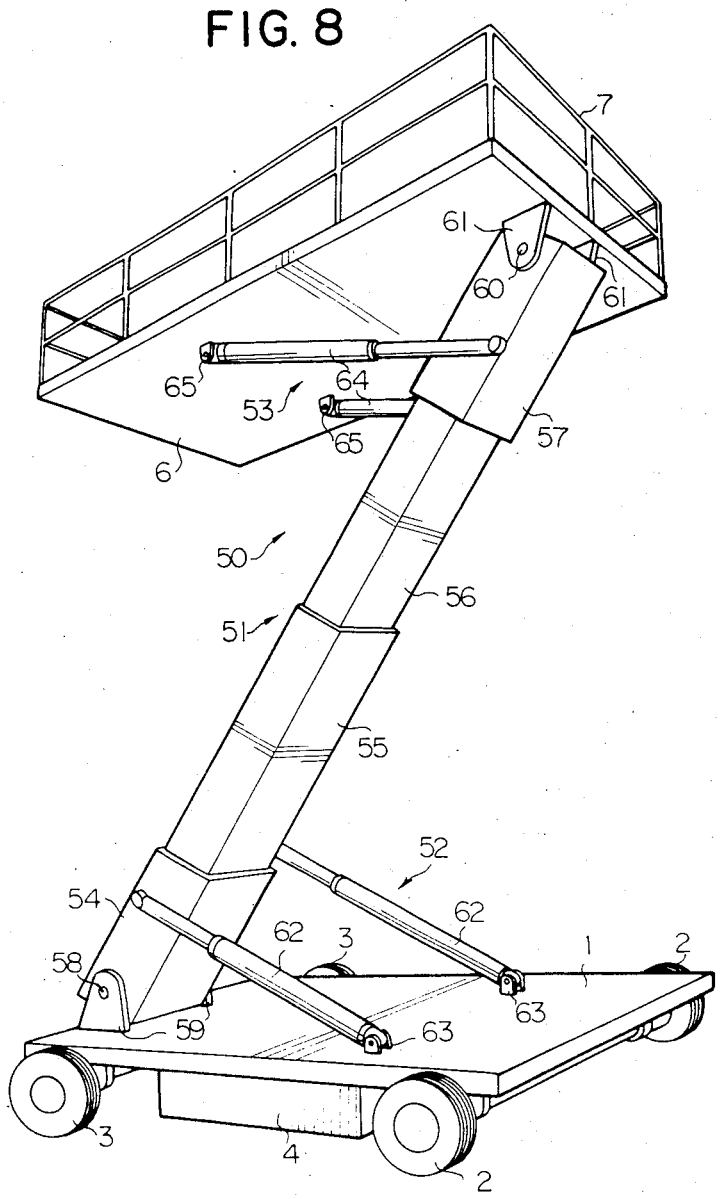
FIG. 8 is a perspective view of an elevating apparatus according to another embodiment of the present invention.
Figure 9:
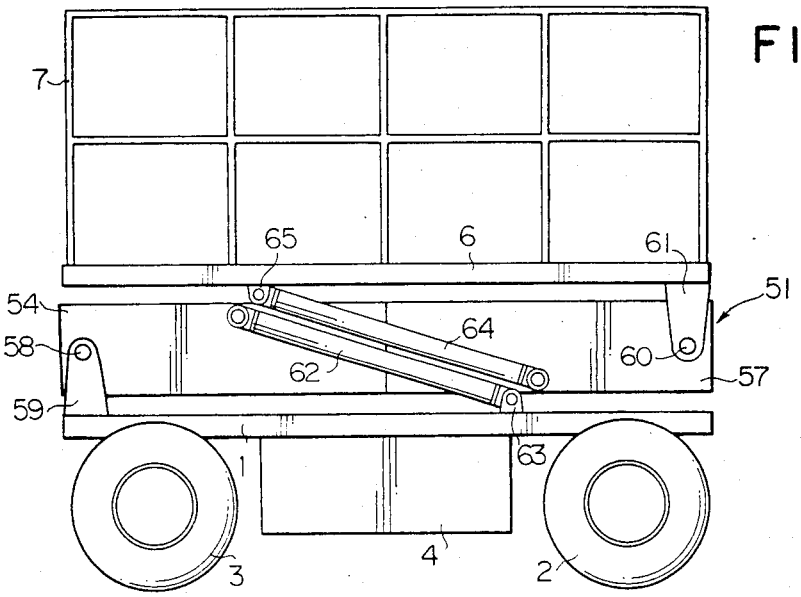
FIG. 9 is a side elevational view of the elevating apparatus of FIG. 8 as it is collapsed.
Figure 10:
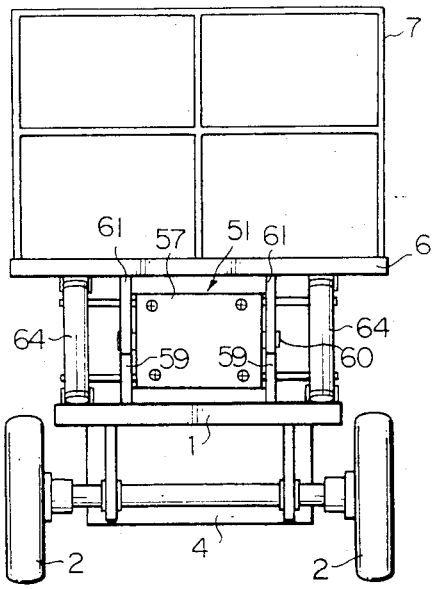
FIG. 10 is a front elevational view of the elevating apparatus illustrated in FIG. 9.
Figure 11:
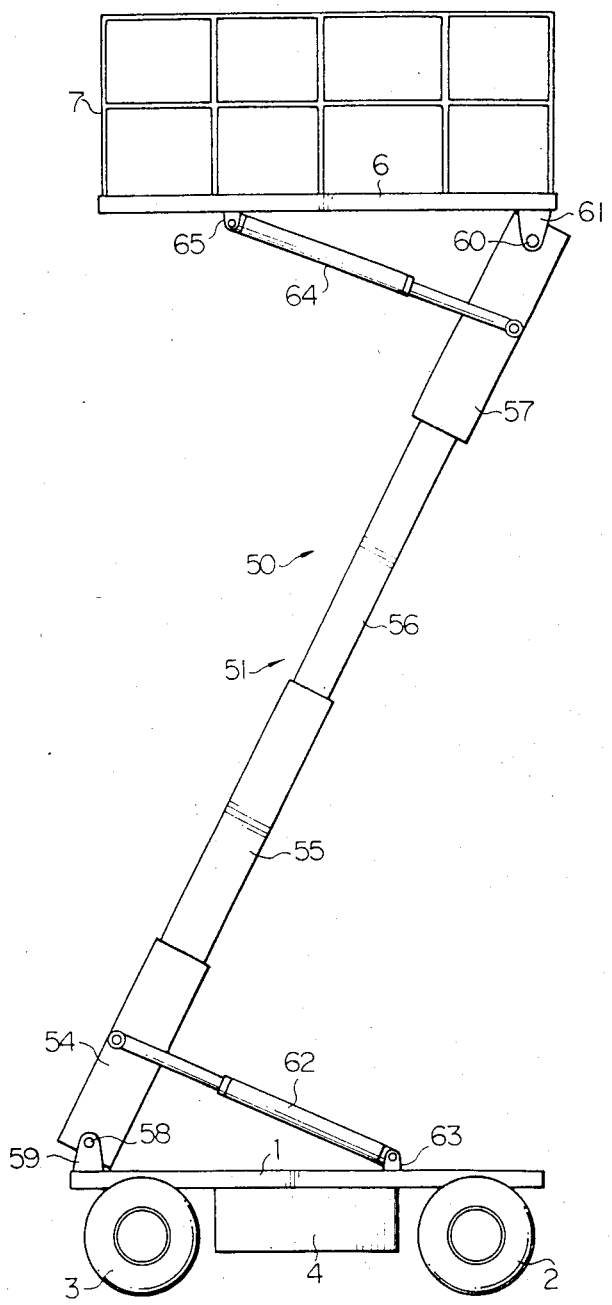
FIG. 11 is a side elevational view of the elevating apparatus with its telescopic boom assembly fully extended.
Figure 12:
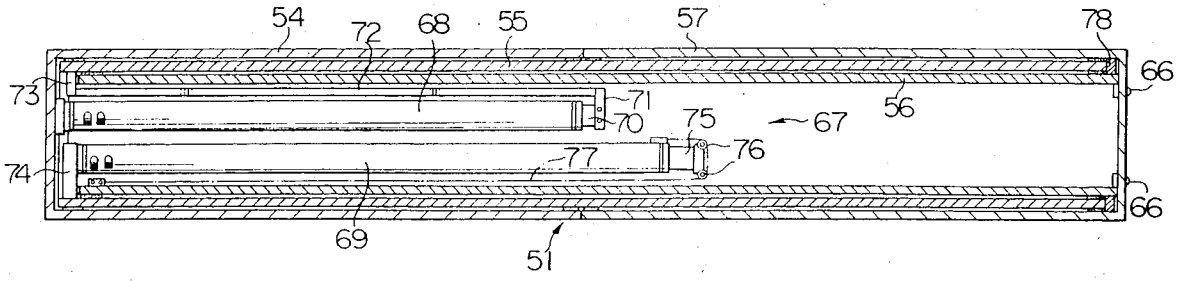
FIG. 12 is a longitudinal cross-sectional view of the telescopic boom assembly shown in FIG. 11.

As shown in FIGS. 8 and 12, the middle boom 55 is slidably disposed in the lower outer boom 54, and the upper boom 56 is slidably disposed in the middle boom 55 remotely from the lower outer boom 54. When the telescopic boom assembly 51 is contracted, the middle boom 55 is slidably disposed also in the upper outer boom 57. The upper boom 56 has an upper end inserted in the upper outer boom 57, the upper end of the upper boom 56 being fixed to the upper end of the upper outer boom 57 by screws 66 (FIG. 12). An equal clearance or gap is left between the outer peripheral surface of the upper boom 56 and the inner peripheral surface of the upper outer boom 57. Each of the lower and upper outer booms 54, 57 is of a length which is about half the length of the chassis 1. An extension and contraction mechanism 67 is disposed in the telescopic boom assembly 51, and includes a pair of parallel hydraulic cylinders 68, 69 disposed in the upper boom 56 in parallel relation thereto. The hydraulic cylinder 68 has a cylinder end fixed to the lower outer boom 54 and includes a piston rod 70 fixed to a transverse adapter 71 secured to a rod 72 extending parallel to the hydraulic cylinder 68, the rod 24 being connected by a block 73 to the lower end of the middle boom 55. The hydraulic cylinder 69 has a cylinder end fixed by a block 74 to the lower end of the middle boom 55 and a piston rod 75 on which pulleys 76 are rotatably mounted. A wire 77 having end end fastened to the hydraulic cylinder 69 is trainted around the pulleys 76, 76 and has an opposite end fastened to the lower end of the upper boom 56. A spacer 78 in the form of a rectangular frame is slidably disposed between the upper boom 56 and the upper outer boom 57, the spacer 78 having an outer peripheral surface substantially identical in shape to the inner peripheral surface of the upper outer boom 57, and an inner peripheral surface substantially identical in shape to the outer peripheral surface of the upper boom 56. The spacer 78 is normally held in contact with the distal end of the middle boom 55.

Figure 14:
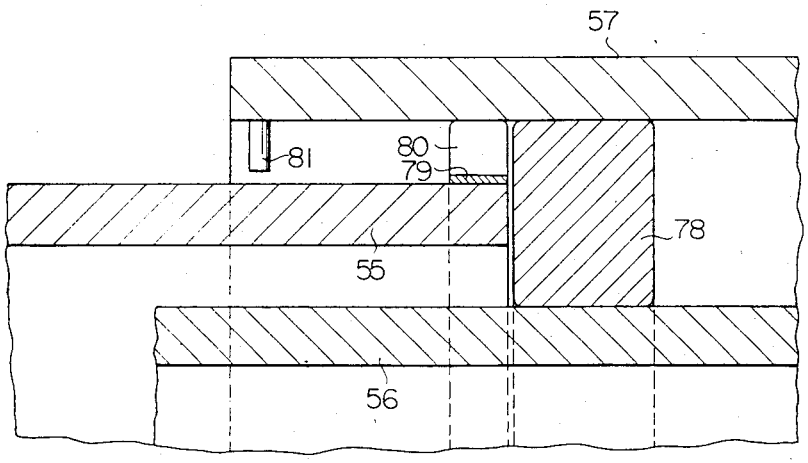
FIG. 14 is an enlarged fragmentary cross-sectional view of the components shown in FIG. 13.
Figure 15:
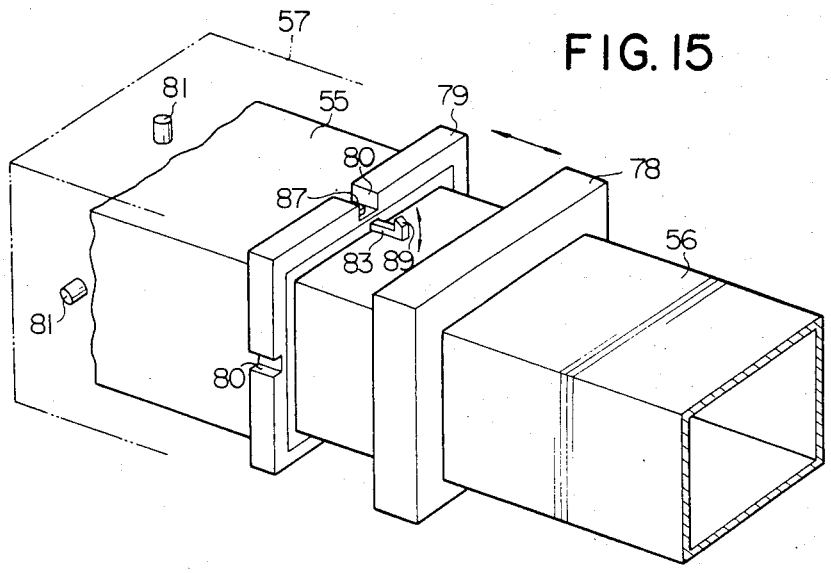
FIG. 15 is a fragmentary perspective view showing a spacer lock mechanism

As shown in FIGS. 14 and 15, another frame-shaped slider 79 is fixedly disposed around the distal end of the middle boom 55, the slider 79 having an outer peripheral surface substantially identical in shape to the inner peripheral surface of the upper outer boom 57. The slider 79 has four sides each having a central recess 80 opening outwardly. The upper outer boom 57 has four stop pins 81 mounted on the lower end of the upper outer boom 57 and directed inwardly, the stop pins 81 being held in longitudinal alignment with the recesses 80, respectively, but terminating short of the bottoms of the recesses 80 so as not to interfere with the slider 79.

The elevating apparatus shown in FIGS. 8 through 14 operates as follows: In FIGS. 2 and 3, the telescopic boom assembly 51 is contrated to lower the platform 6. After a worker or workers and/or materials are placed on the platform 6, the engine in the power box 4 is driven to supply oil under pressure into the hydraulic cylinders 62, 64, 68, 69. The piston rods 70, 75 of the hydraulic cylinders 68, 69 are now extended to push the middle boom 55 out of the lower outer boom 54 and also push the upper boom 56 out of the middle boom 55, thereby increasing the distance between the pins 58, 60. As the hydraulic cylinders 62 are extended, the lower outer boom 54 is turned about the pin 58 to tilt the telescopic boom assembly 51 upwardly away from the chassis 1. By extending the telescopic boom assembly 51 with the hydraulic cylinders 68, 69 in synchronism with the tilting movement of the telescopic boom assembly 51, the pin 60 on the upper outer boom 57 rises perpendicularly to the chassis 1. In response to the extension of the hydraulic cylinders 64, the platform 6 is turned about the pin 60 away from the upper outer boom 57. By controlling the hydraulic cylinders 62, 64 to extend at the same rate, the platform 6 is kept parallel to the chassis 1, and hence the chassis 1, the telescopic boom assembly 51, and the platform 16 jointly assume the shape of a Z when seen in side elevation. When the platform 6 reaches a desired lifted position, the operation of the hydraulic cylinders 62, 64, 68, 69 is stopped to maintain the platform 6 in the elevated position. Now, the desired activity such as assembly, repair or painting can be effected on the platform 6.

When the telescopic boom assembly 51 is extended by the hydraulic cylinders 68, 69, the middle boom 55 is drawn out of the upper boom 56 along the upper outer boom 56, and the spacer 78 is simultaneously slid on the outer peripheral surface of the upper boom 56 while following the distal end of the middle boom 55. When the distal end of the middle boom 55 arrives in the vicinity of the lower end of the upper outer boom 12, the stop pins 81 pass through the respective recesses 80, allowing the distal end of the middle boom 55 to continue to move beyond the lower end of the upper outer boom 57. However, the spacer 78 is blocked by the stop pins 81 and remains held in the lower end of the upper outer boom 57. Therefore, the spacer 78 is positioned between the upper outer boom 57 and the upper boom 56 in the vicinity of the lower end of the upper outer boom 57. The spacer 78 thus positioned is effective in bearing lateral forces applied to the upper outer boom 57 by the hydraulic cylinders 64, thereby keeping the upper outer boom 57 spaced properly from the upper boom 56 against the applied forces. When the platform 6 is to be lowered, the hydraulic cylinders 62, 64, 68, 69 are contracted to contract the telescopic boom assembly 51. The platform 6 is then lowered toward the chassis 1 in parallel relation thereto.

Figure 13:
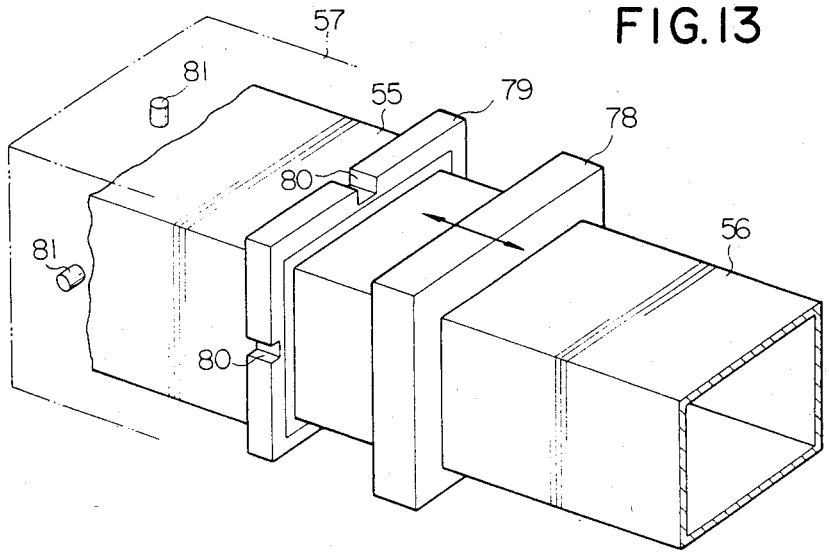
FIG. 13 is a fragmentary perspective view of components in the vicinity of the lower end of an upper outer boom of the telescopic boom assembly of FIG. 11.

Although not specifically shown in FIGS. 13 and 14, various known means can be used for enabling the spacer 78 to move with the middle boom 55 when the middle boom 55 is moved out of the upper outer boom 55. For example, the distal end of the middle boom 55 may be provided with hooks resiliently lockable in respective pins on the spacer 78.

Figure 16:
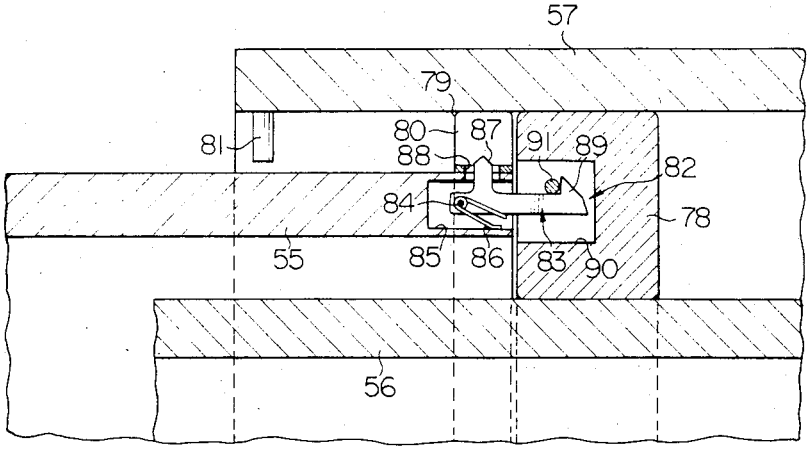
FIG. 16 is an enlarged fragmentary cross-sectional view of the spacer lock mechanism shown in FIG. 15.

FIGS. 15 and 16 show a spacer lock mechanism 82 composed of an L-shaped hook member 83 swingably mounted by a pin 84 in a recess 85 defined in the upper end of the middle boom 55. The hook member 83 lies in the longitudinal direction of the middle boom 55 and is normally urged to turn counterclockwise (FIG. 16) by a torsion spring 86 disposed around the pin 84. The hook member 83 has an actuator 87 projecting through the middle boom 55 and a hole 88 in the slider 79 into one of the recesses 80. The hook member 83 also has a hook 89 on its free end, which can be moved into and out of a recess 90 defined in the side of the spacer 78 which faces the middle boom 55. The hook 89 when placed in the recess 90 lockingly engages a pin 91 disposed in the recess 90.

In operation, the spacer 78 is coupled to the middle boom 55 by the hook 89 engaging the pin 91 as shown in FIG. 16 when the middle boom 55 is moved in the direction out of the upper outer boom 57 at the time the telescopic boom assembly 51 is extended. When the distal end of the middle boom 55 is positioned in the vicinity of the lower end of the upper outer boom 57, the stop pin 81 shown in FIG. 16 passes through the recess 80, pushing the actuator 87 to turn the hook member 83 clockwise (FIG. 16) about the pin 84. The hook 89 is now disengaged from the pin 91 to separate the middle boom 55 from the spacer 78. As the middle boom 55 continues to move out of the upper outer boom 57, the distal end of the middle boom 55 together with the slider 79 is slid away from the upper outer boom 57. However, the spacer 78 is stopped by the stopper pins 81 and retained in the lower end of the upper outer boom 57. When the middle boom 55 is moved back into the upper outer boom 57 at the time of contracting the telescopic boom assembly 51, the slider 79 is first moved past the pins 81 into the upper outer boom 57. The hook 89 enters the recess 90 and slides against the pin 91, causing the hook member 83 to turn clockwise against the resiliency of the spring 86 until the hook 89 lockingly engages the pin 91. The spacer 78 is not locked on the middle boom 55. As the middle boom 55 further moves into the upper outer boom 57, the spacer 78 is pushed thereby back into the upper outer boom 57.

Figure 17:
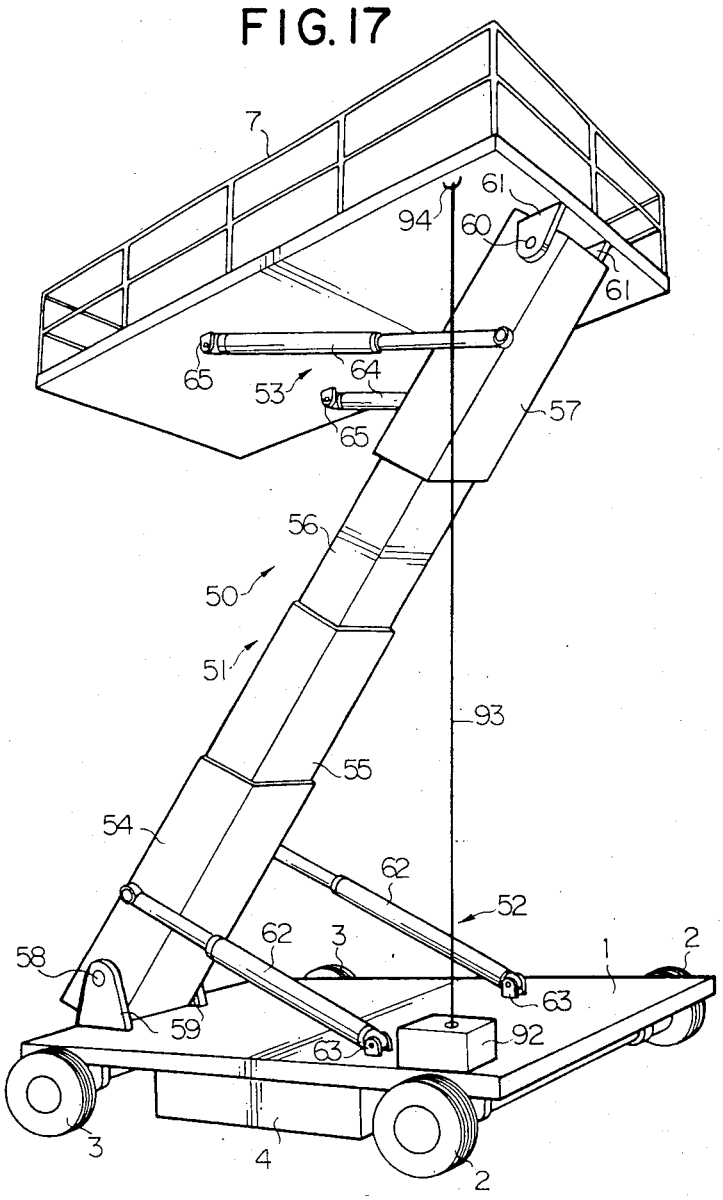
FIG. 17 is a perspective view of an elevating apparatus according to still another embodiment of the present invention.
Figure 18:
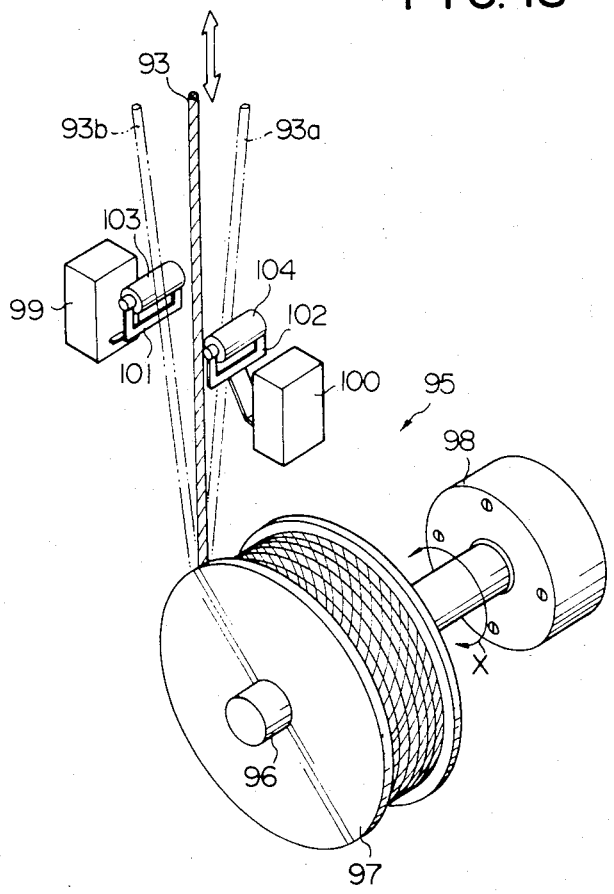
FIG. 18 is a perspective view of a detector mechanism incorporated in the elevating apparatus illustrated in FIG. 17.
Figure 19:
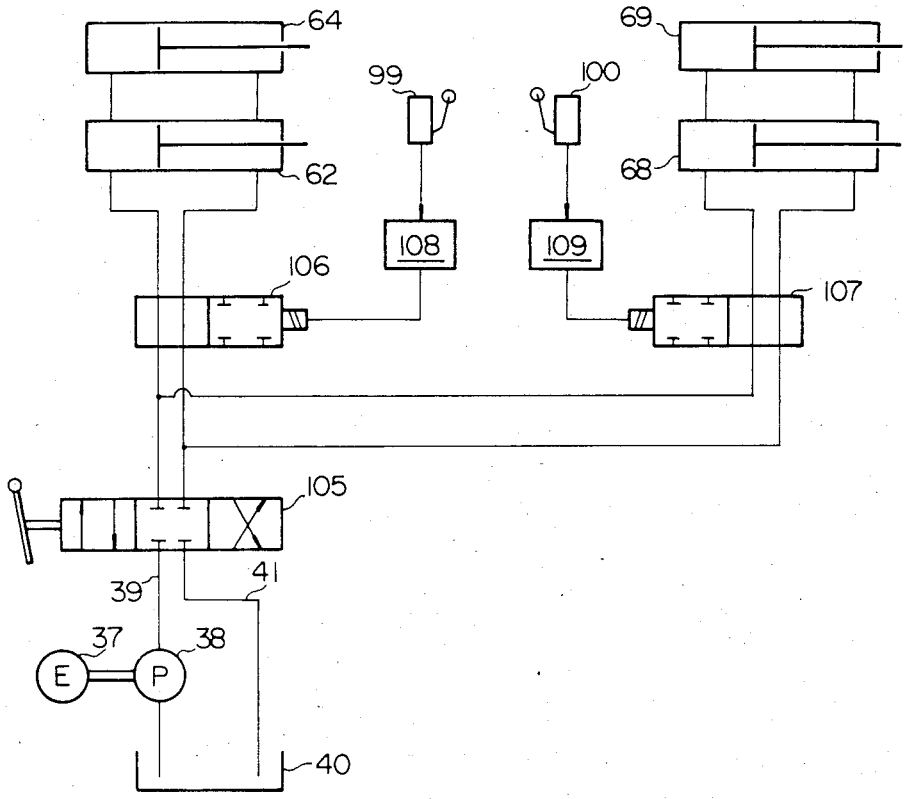
FIG. 19 is a circuit diagram of a hydraulic control system of the elevating apparatus shown in FIG. 17.

FIGS. 17 through 19 show an elevating apparatus according to still another embodiment of the present invention. The elevating apparatus shown in FIG. 17 is substantially the same as that illustrated in FIG. 8, except that it additionally has an error detector 92 is mounted on the chassis 1 adjacent to one of the front wheels 2. The error detector 92 includes a vertical reference wire 93 having its upper end fastened to a hook 94 mounted on the lower surface of the platform 6. The vertical reference wire 93 is kept under tension by a detector mechanism 95 disposed in the error detector 92, as shown in FIG. 18.

As illustrated in FIG. 18, the detector mechanism 95 includes a horizontal shaft 96 on which there is fixedly mounted a drum 97 with the wire 93 wound therearound. A tensioner 98 comprising a spiral spring, for example, is coupled to an end of the shaft 96 for normally urging the shaft 96 to turn about its own axis in the direction of the arrow X. The wire 93 unwound from the drum 97 tangentially extends upwardly. The detector mechanism 95 also includes a pair of limit switches 99, 100 laterally spaced from each other with the wire 93 positioned therebetween. The limit switch 99, 100 have respective levers 101, 102 supporting thereon rollers 103, 104, respectively, positioned in slightly spaced relation to the vertical wire 93.

The elevating apparatus shown in FIG. 17 is controlled by a hydraulic control system illustrated in FIG. 19. The hydraulic control system includes a manual directional control valve 105 connected by the supply passage 39 to the pump 38 driven by the engine 37, the pump 38 being connected to the oil reservoir 40, the manual directional control valve 105 being coupled by the return passage 41 to the oil reservoir 40. The manual directional control valve 105 is also coupled through a solenoid-operated valve 106 to the hydraulic cylinders 62, 64 (only two shown in FIG. 19) connected in series with each other, and through a solenoid-operated valve 107 to the hydraulic cylinders 68, 69 disposed in the telescopic boom assembly and connected in series with each other. The solenoid-operated valve 106 is connected via a controller 108 to the limit switch 99, while the solenoid-operated valve 107 is connected via a controller 109 to the limit switch 100.

When the telescopic boom assembly 51 is to be extended, the manual directional control valve 105 is shifted to the right (FIG. 19) to supply oil under pressure from the pump 38 through the solenoid-operated valves 106, 107 to thereby extend the hydraulic cylinders 62, 64 and the hydraulic cylinders 68, 69. The hydraulic cylinders 62, 64, 68, 69 are extended unless the vertical reference wire 93 extends vertically without contacting the rollers 103, 104. If the hydraulic cylinders 62, 64 and the hydraulic cylinders 68, 69 are supplied with different amounts of oil under pressure, and hence the extension of the telescopic boom assembly 51 and the tilting of the telescopic boom assembly 51 with respect to the chassis 1 are not well coordinated, then the platform 6 is horizontally displaced with respect to the chassis 1 while it is moving upwardly. The vertical reference wire 93 is then laterally displaced to a position indicated by 93*a* or 93*b* (FIG. 18) in which the wire 93 contacts the roller 103 or 104 to actuate the limit switch 99 or 100. The limit switch 99 or 100 as actuated causes the controller 108 or 109 to close the solenoid-operated valve 106 or 107 for thereby stop the movement of the hydraulic cylinders 62, 64 or 68, 69. The other hydraulic cylinders 62, 64 or 68, 69 continue to extend the boom assembly 51 or tilt the same with respect to the chassis 1 to compensate for the error. The stopped hydraulic cylinders 62, 64 remain inactivated until the wire 93 extends vertially out of contact with the rollers 103, 104. When the wire 93 is corrected into the vertical position, the limit switch 108 or 109 is inactivated to return the solenoid-operated valve 106 or 107, and the hydraulic cylinders 62, 64 or 68, 69 resume their operation.

Figure 20:
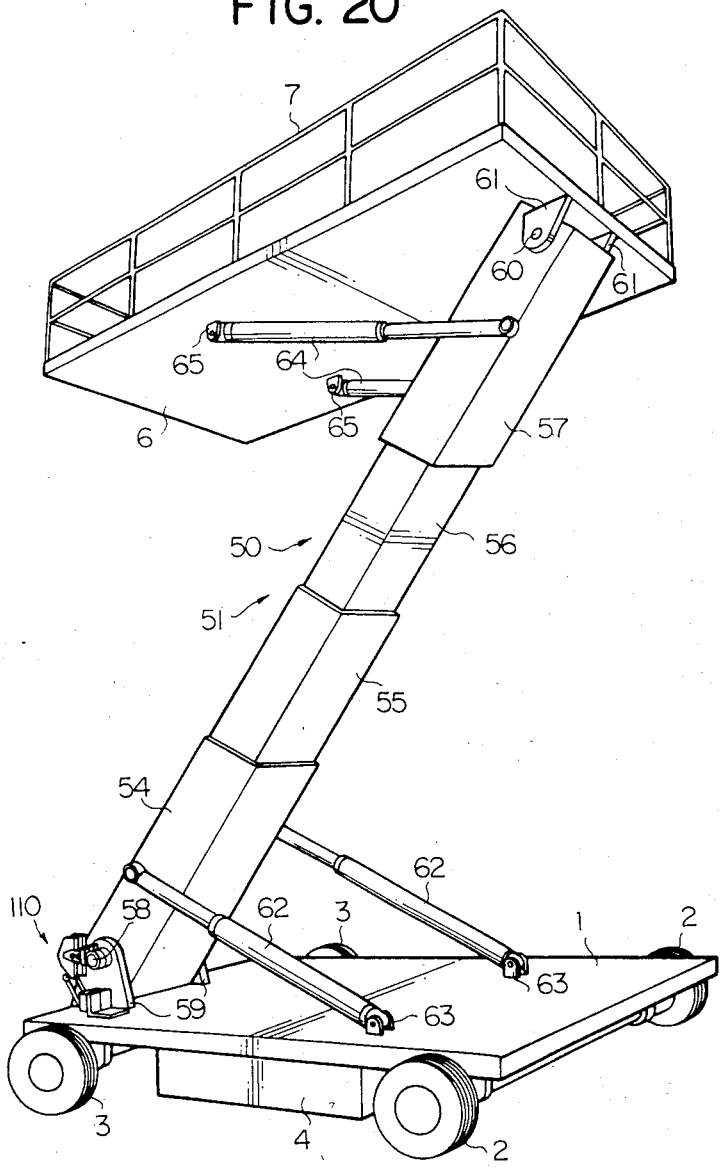
FIG. 20 is a perspective view of an elevating apparatus according to a still further embodiment of the present invention.
Figure 21:
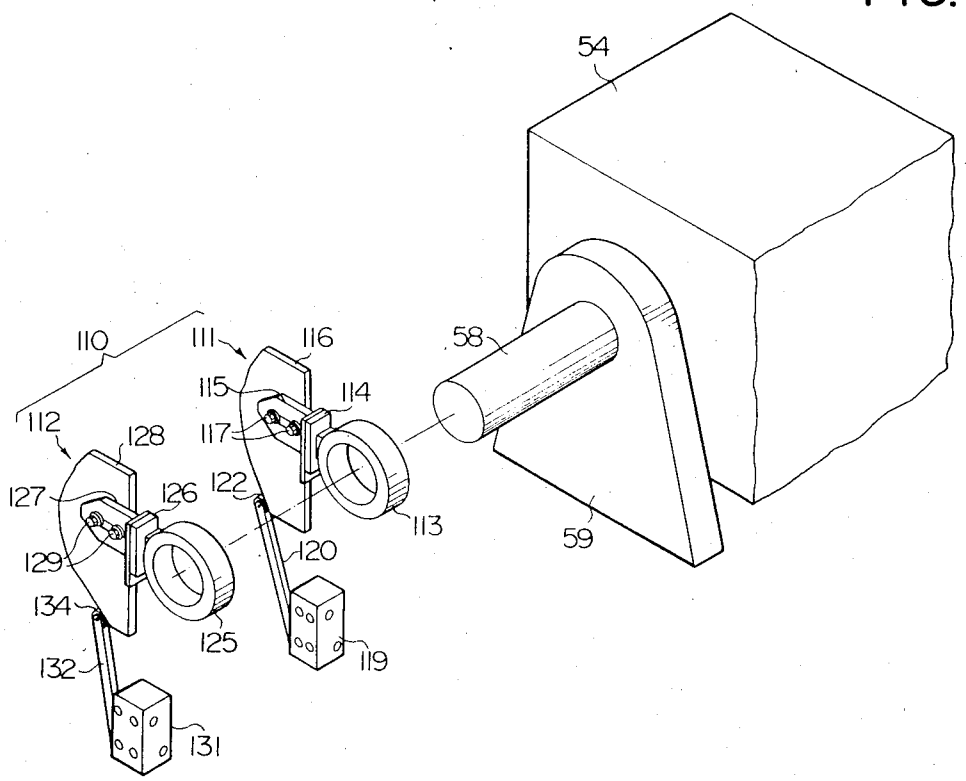
FIG. 21 is an exploded perspective view of an angle detector mechanism in the elevating apparatus of FIG. 20.
Figure 22:
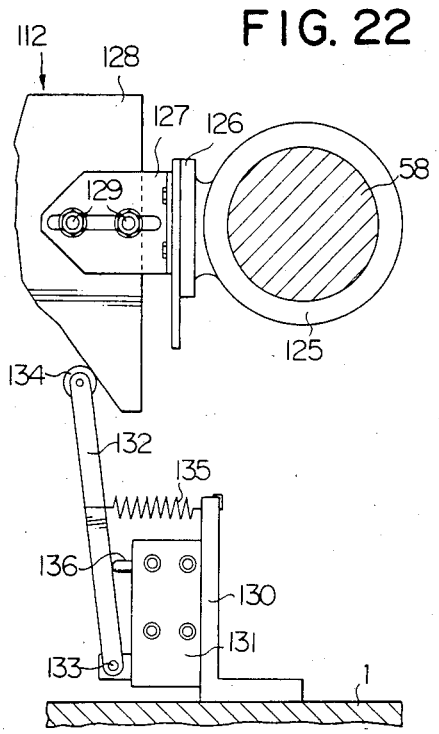
FIG. 22 is an enlarged side elevational view of a tilt control unit of the angle detector mechanism.
Figure 23:
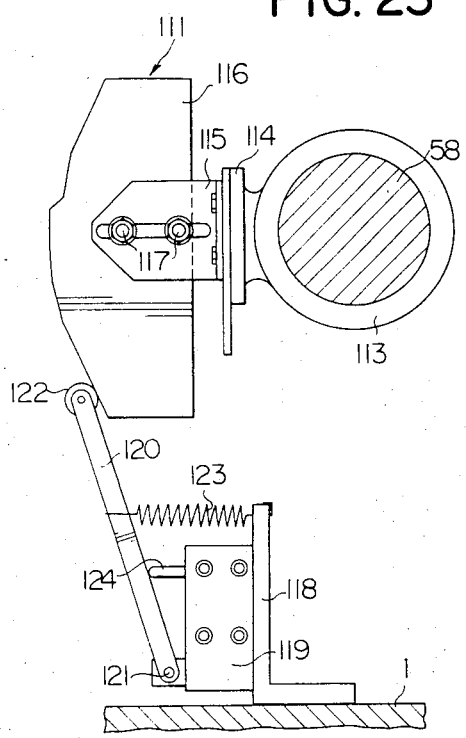
FIG. 23 is an enlarged side elevational view of a telescopic movement control unit of the angle detector mechanism.

FIGS. 20 through 24 show an elevating apparatus according to a still further embodiment of the present invention. The elevating apparatus shown in FIG. 20 is substantially the same as that illustrated in FIG. 8, except that it additionally has an angle detector mechanism 110 mounted on the pin 58 and the chassis 1 for detecting the angle of inclination of the telescopic boom assembly 51 with respect to the chassis 1. FIG. 21 illustrates the angle detector mechanism 110 in greater detail. The angle detector mechanism 110 generally comprises a tilt control unit 111 and a telescopic movement control unit 112 which are disposed between the pin 58 and the chassis 1. As shown in FIGS. 21 and 23, the tilt control unit 111 has a ring 113 fixedly fitted over the pin 58 and including a base 114 to which an angle 115 is fixed. A cam plate 116 is fastened to the angle 115 by screws 117. An angle 118 is fixed to the chassis 1 below the pin 58, and a flow rate control valve 119 is secured to the angle 118. An arm 120 is pivotally connected by a pin 121 and supporting a roller 122 rotatably on its distal end, the roller 122 being held in rolling contact with an outer peripheral edge of the cam plate 116. The arm 120 is normally urged by a spring 123 to cause the roller 122 to be held against the cam plate 116, the arm 120 being held against an actuator rod 124 of the flow rate control valve 119. As illustrated in FIGS. 21 and 22, the telescopic movement control unit 112 has a ring 125 fixedly fitted over the pin 58 and including a base 126 to which an angle 127 is fixed. A cam plate 128 is fastened to the angle 127 by screws 129. An angle 130 is fixed to the chassis 1 below the pin 58, and a flow rate control valve 131 is secured to the angle 130. An arm 132 is pivotally connected by a pin 133 and supporting a roller 134 rotatably on its distal end, the roller 134 being held in rolling contact with an outer peripheral edge of the cam plate 128. The arm 132 is normally urged by a spring 135 to cause the roller 134 to be held against the cam plate 128, the arm 132 being held against an actuator rod 136 of the flow rate control valve 131.

Figure 24:
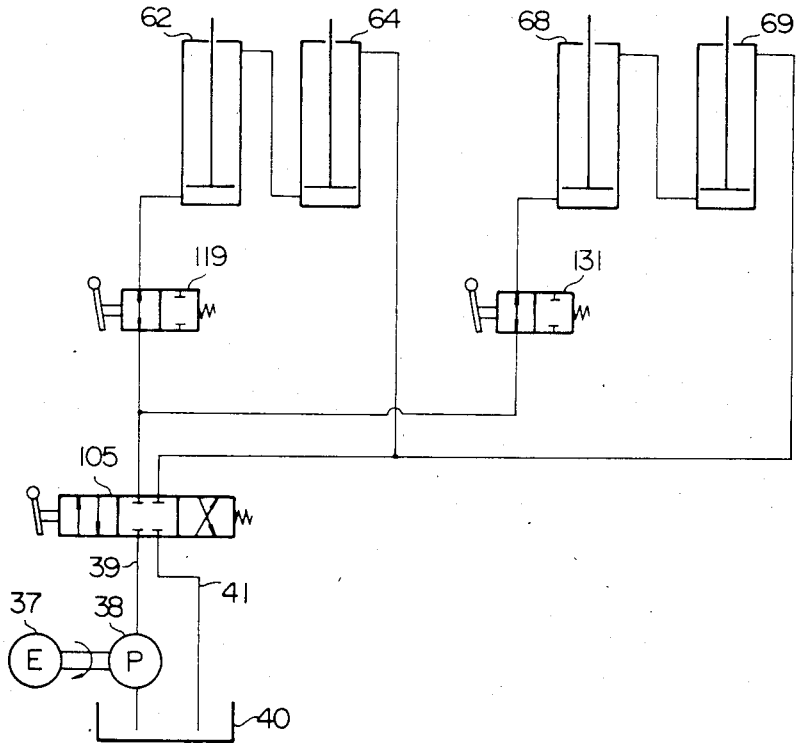
FIG. 24 is a circuit diagram of a hydraulic control system of the elevating apparatus shown in FIG. 20.

FIG. 24 shows a hydraulic control system in which the manual directional control valve 105 is connected through the flow rate control valve 119 to the hydraulic cylinders 62, 64 and also through the flow rate control valve 131 to the hydraulic cylinders 68, 69.

For extending the telescopic boom assembly 51, the manual directional control valve 105 is shifted to the right (FIG. 24) to allow oil under pressure to flow from the pump 38 to the hydraulic cylinders 62, 63, 68, 69, which start to extend their piston rods. The telescopic boom assembly 51 is now extended and tilted upwardly away from the chassis 1. As the telescopic boom assembly 51 is tilted upwardly, the pin 58 is also turned about its own axis to turn the cam plates 116, 128. The rollers 122, 134 roll on the cam plates 116, 128 to cause the arms 120, 132 to angularly move about the pins 121, 133 for thereby pushing the actuator rods 124, 136 to control the rates of flow of oil through the flow rate control valves 119, 131, respectively. The movement of the hydraulic cylinders 62, 64, 68, 69 is therefore controlled by the configurations of the cam plates 116, 128 so that the pin 60 will be raised along a straight line perpendicular to the chassis 1. The platform 6 can thus be elevated vertially without lateral displacements.

Although certain preferred embodiments have been shown and described, it should be understood that many changes and modifications may be made therein without departing from the scope of the appended claims.

What is claimed is:

1. An elevating apparatus comprising:

(a) a base;

(b) a platform:

(c) a telescopic boom assembly connecting said base and said platform together, said telescopic boom assembly being composed of a lower outer boom pivotally coupled to said base, an upper outer boom pivotally coupled to said platform, and a middle boom slidably receiving said lower outer boom and slidably movable in and out of said upper outer boom, and an upper boom inserted in and fixed to said upper outer boom;

(d) at least one first hydraulic cylinder disposed in said telescopic boom assembly for extending and contracting said telescopic boom assembly;

(e) at least one second hydraulic cylinder operatively coupled between said telescopic boom assembly and said base for tilting said telescopic boom assembly with respect to said base; and (f) at least one third hydraulic cylinder operatively coupled between said telescopic boom assembly and said platform for keeping said platform substantially parallel to said base.

2. An elevating apparatus according to claim 1, including a spacer slidably inserted between said upper outer boom and said upper boom and movable in and along said upper outer boom with said middle boom, and means for locking said spacer to said middle boom when said middle boom is positioned in said upper outer boom and for unlocking said spacer from said middle boom when said middle boom moves out of said upper outer boom.

3. An elevating apparatus according to claim 2, wherein said means comprises a pin mounted on said spacer and a hook pivotally mounted on said middle boom for locking engagement with said pin, said upper outer boom having a fixed pin engageable with said hook to cause said hook to disengage from said pin on said spacer when said middle boom moves out of said upper outer boom.

4. An elevating apparatus according to claim 1, further including a hydraulic control system for operating said first, second, and third hydraulic cylinders in synchronism to move said platform toward and away from said base in a substantially perpendicular relation to said base.

5. An elevating apparatus comprising:

(a) a base;

(b) a platform;

(c) a telescopic boom assembly connecting said base and said platform together, said telescopic boom assembly being composed of a lower outer boom pivotally coupled to said base, an upper boom pivotally coupled to said platform, and a middle boom slidably receiving said lower outer boom and slidably movable in and out of said upper boom;

(d) an adapter having an end fixed to said upper boom and another end being extended longitudinally in parallel to said telescopic boom assembly:

(e) at least one first hydraulic cylinder disposed in said telescopic boom assembly for extending and contracting said telescopic boom assembly;

(f) at least one second hydraulic cylinder operatively coupled between said telescopic boom assembly and said base for tilting said telescopic boom assembly with respect to said base;

(g) at least one third hydraulic cylinder operatively coupled between said telescopic boom assembly and said platform for keeping said platform substantially parallel to said base; and (h) an error detector mechanism mounted on said base and said platform for detecting a lateral deviation of said platform from a reference path thereof as it moves toward and away from said platform.

6. An elevating apparatus according to claim 5, wherein said error detector mechanism comprises a drum rotatably mounted on said base, a wire wound around said drum and having an end portion unwound therefrom and attached to said platform under tension, and a pair of limit switches disposed one on each side of said end portion for being triggered by the lateral deviation of said wire end portion, said limit switches being operatively coupled to said hydraulic control system to control operation thereof.

7. An elevating apparatus comprising:

(a) a base;

(b) a platform;

(c) a telescopic boom assembly connecting said base and said platform together, said telescopic boom assembly being composed of a lower outer boom pivotally coupled to said base, an upper boom pivotally coupled to said platform, and a middle boom slidably receiving said lower outer boom and slidably movable in and out of said upper boom;

(d) an adapter having an end fixed to said upper boom and another end being extended longitudinally in parallel to said telescopic boom assembly:

(e) at least one first hydraulic cylinder disposed in said telescopic boom assembly for extending and contracting said telescopic boom assembly;

(f) at least one second hydraulic cylinder operatively coupled between said telescopic boom assembly and said base for tilting said telescopic boom assembly with respect to said base;

(g) at least one third hydraulic cylinder operatively coupled between said telescopic boom assembly and said platform for keeping said platform substantially parallel to said base; and (h) an angle detector mechanism mounted on said base for detecting the angle of inclination of said telescopic boom assembly with respect to said base.

8. An elevating apparatus according to claim 7, wherein said angle detector mechanism includes a tilt control unit comprising a first cam plate angularly movable with said telescopic boom assembly and a first flow rate control valve mounted on said base and actuatable by said first cam plate, and a telescopic movement control unit comprising a second cam plate angularly movable with said telescopic boom assembly and a second flow rate control valve mounted on said base and actuatable by said second cam plate, said first and second flow rate control valves being disposed in said hydraulic control system for controlling said second and third hydraulic cylinders and said first hydraulic cylinder, respectively.

9. An elevating apparatus comprising:

(a) a base;

(b) a platform;

(c) a telescopic boom assembly connecting said base and said platform together, said telescopic boom assembly being composed of a lower outer boom pivotally coupled to said base, an upper boom pivotally coupled to said platform, and a middle boom slidably receiving said lower outer boom and slidably movable in and out of said upper boom;

(d) an adapter having an end fixed to said upper boom and another end being extended longitudinally in parallel to said telescopic boom assembly:

(e) at least one first hydraulic cylinder disposed in said telescopic boom assembly for extending and contracting said telescopic boom assembly;

(f) at least one second hydraulic cylinder operatively coupled between said telescopic boom assembly and said base for tilting said telescopic boom assembly with respect to said base; and (g) at least one third hydraulic cylinder operatively coupled between said telescopic boom assembly and said platform for keeping said platform substantially parallel to said base.

10. An elevating apparatus according to claim 9, wherein said third hydraulic cylinder is coupled between said adapter and said platform.

11. An elevating apparatus according to claim 9, further including a hydraulic system for operating said first, second, and third hydraulic cylinders in synchronism to move said platform toward and away from said base in a substantially perpendicular relation to said base.

12. An elevating apparatus comprising:

(a) a base;

(b) a platform;

(c) a telescopic boom assembly connecting said base and said platform together, said telescopic boom assembly being composed of a lower outer boom pivotally coupled to said base, an upper outer boom pivotally coupled to said platform, and a middle boom slidably receiving said lower outer boom and slidably movable in and out of said upper outer boom, and an upper boom inserted in and fixed to said upper outer boom;

(d) at least one first hydraulic cylinder disposed in said telescopic boom assembly for extending and contracting said telescopic boom assembly;

(e) at least one second hydraulic cylinder operatively coupled between said telescopic boom assembly and said base for tilting said telescopic boom assembly with respect to said base;

(f) at least one third hydraulic cylinder operatively coupled between said telescopic boom assembly and said platform for keeping said platform substantially parallel to said base; and (g) an error detector mechanism mounted on said base and said platform for detecting a lateral deviation of said platform from a reference path thereof as it moves toward and away from said platform.

13. An elevating apparatus according to claim 12, wherein said error detector mechanism comprises a drum rotatably mounted on said base, a wire wound around said drum and having an end portion unwound therefrom and attached to said platform under tension, and a pair of limit switches disposed one an each side of said end portion for being triggered by the lateral deviation of said wire end portion, said limit switches being operatively coupled to said hydraulic control system to control operation thereof.

14. An elevating apparatus comprising:

(a) a base;

(b) a platform;

(c) a telescopic boom assembly connecting said base and said platform together, said telescopic boom assembly being composed of a lower outer boom pivotally coupled to said base, an upper outer boom pivotally coupled to said platform, a middle boom slidably receiving said lower outer boom and slidably movable in and out of said upper boom, and an upper boom inserted in and fixed to said upper outed boom;

(d) at least one first hydraulic cylinder disposed in said telescopic boom assembly for extending and contracting said telescopic boom assembly;

(e) at least one second hydraulic cylinder operatively coupled between said telescopic boom assembly and said base tilting said telescopic boom assembly with respect to said base;

(f) at least one third hydraulic cylinder operatively coupled between said telescopic boom assembly and said platform for keeping said platform substantially parallel to said base; and (g) an angle detector mechanism mounted on said base for detecting the angle of inclination of said telescopic boom assembly with respect to said base.

15. An elevating apparatus according to claim 14, wherein said angle detector mechanism including a tilt control unit comprising a first cam plate angularly movable with said telescopic boom assembly and a first flow rate control valve mounted on said base and actuatable by said first cam plate, and a telescopic movement control unit comprising a second cam plate angularly movable with said telescopic boom assembly and a second flow rate control valve mounted on said base and actuatable by said second cam plate , said first and second flow rate control valve being disposed in said hydraulic control system for controlling said second and third hydraulic cylinders and said first hydraulic cylinder, respectively.

16. An elevating apparatus comprising:

(a) a base;

(b) a platform;

(c) a telescopic boom assembly connecting said base and said plateform together, said telescopic boom assembly being composed of a plurality of telescopically coupled booms axially aligned with each other;

(d) at least one first hydraulic cylinder disposed in said telescopic boom assembly for extending and contracting said telescopic boom assembly;

(e) at least one second hydraulic cylinder operatively coupled between said telescopic boom assembly and said base for tilting said telescopic boom assembly with respect to said base;

(f) at least one third hydraulic cylinder operatively coupled between said telescopic boom assembly and said platform for keeping said platform substantially parallel to said base;

(g) a hydraulic control system for operating said first, second, and third hydraulic cylinders in synchronisms to move said platform toward and away from said base in a substantially perpendicular relation to said base; and (h) an angle detector mechanism mounted on said base for detecting the angle of inclination of said telescopic boom assembly with respect to said base, said angle detector mechanism including a tilt control unit comprising a first cam plate angulary movable with said telescopic boom assembly and a second flow rate control valve mounted on said base and actuatable by said first cam plate, and a telescopic movement control unit comprising a second cam plate angularly movable with said telescopic boom assembly and a second flow rate control valve mounted on said base and actuatable by said second cam plate, said first and second flow rate control valves being disposed in said hydraulic control system for controlling said second and third hydraulic cylinders and said first hydraulic cylinder, respectively.

* * * * *